US005102619A

United States Patent [19]

Garrison, Jr. et al.

[11] Patent Number: 5,102,619

[45] Date of Patent: Apr. 7, 1992

[54] FERROUS ALLOYS HAVING ENHANCED FRACTURE TOUGHNESS AND METHOD OF MANUFACTURING THEREOF

[75] Inventors: Warren M. Garrison, Jr., Pittsburgh, Pa.; Jack W. Bray, Richmond, Va.; James L. Maloney, III, South Greensburg, Pa.

[73] Assignee: Latrobe Steel Company, Latrobe, Pa.

[21] Appl. No.: 361,910

[22] Filed: Jun. 6, 1989

[51] Int. Cl.[5] ..... C22C 38/50

[52] U.S. Cl. ..... 420/109; 420/107; 420/108; 420/115; 75/508

[58] Field of Search ..... 420/126, 129, 107, 108, 420/109, 110, 115, 49

[56] References Cited

U.S. PATENT DOCUMENTS 3,183,078 5/1965 Ohtake et al. ..... 420/126

FOREIGN PATENT DOCUMENTS 499602 1/1954 Canada ..... 420/126
45-40655 12/1970 Japan ..... 420/126
59-096218 6/1984 Japan .
60-155653 8/1985 Japan .
60-221555 11/1985 Japan .

*Primary Examiner*—Deborah Yee
*Attorney, Agent, or Firm*—Walter J. Blenko, Jr.

[57] ABSTRACT

A high strength vacuum melted ferrous alloy having enhanced fracture toughness comprising not more than about 0.01% by weight sulfur, not more than about 0.1% manganese, and titanium in an amount in atomic percent of not less than about twice the atomic percentage of sulfur present in the alloy. Other detailed limits of titanium, zirconium, and niobium are also disclosed.

14 Claims, No Drawings

FERROUS ALLOYS HAVING ENHANCED FRACTURE TOUGHNESS AND METHOD OF MANUFACTURING THEREOF

This invention relates to ferrous alloys having enhanced fracture toughness, more particularly it relates to high strength vacuum melted ferrous alloys.

It has long been a desire of ferrous metallurgists to achieve high levels of toughness in ferrous alloys coupled with high strength levels. Numerous steps have been taken in an effort to achieve that result, e.g., to reduce the volume fraction of inclusions, to control the spacing of inclusions and to control the fine scale microstructure through control of composition or heat treatment.

In most steels the inclusions are primarily manganese sulfides (MnS) although other inclusions may also be found. The amount of MnS inclusions may be minimized by keeping the sulfur content as low as possible. In present day technology, sulfur levels are normally at or close to a practicable minimum amount and further sulfur reductions would be exceedingly expensive.

We improve the fracture toughness of high strength ferrous alloys by replacing the MnS inclusions by titanium carbosulfide inclusions, e.g. $Ti_4C_2S_2$. In order to form titanium carbosulfide inclusions it is necessary to keep the manganese level low and to add at least enough titanium to fully bond to all of the available sulfur. Desirably, some excess titanium may be provided in order to insure complete bonding, recognizing that in the absence of excess titanium manganese sulfides may form.

Fracture toughness is dependent, in some measure, upon the absence of voids in the steel. Stated in other terms, the existence of voids tends to reduce the fracture toughness. It is more difficult to nucleate voids at carbosulfide inclusions than at MnS inclusions. Accordingly, elimination of MnS inclusions and replacement of them by titanium carbosulfides increases the fracture toughness of the steel.

We provide a high strength vacuum refined melt of ferrous alloy having enhanced fracture toughness which comprises not more than about 0.01% sulfur by weight, not more than about 0.1% manganese by weight and titanium in an an atomic percent of not less than about twice the atomic percent of sulfur present in the alloy. We prefer to maintain titanium in an amount from about 2 to about 30 times the atomic percentage of sulfur in the alloy. Preferably we maintain the titanium in an amount from about 2 to about 7 times the atomic percentage of sulfur present in the alloy.

We prefer to minimize the presence of strong carbide forming elements such as zirconium and niobium preferably maintaining each of them in amounts of not more than about 0.006% by weight.

Preferably we manufacture the alloy by vacuum refining whereby both nitrogen and oxygen are significantly and substantially reduced. Thereafter, titanium in the desired amount is added to the heat for reaction with the sulfur to form titanium carbosulfide inclusions.

We employ our invention in high strength ferrous alloys selected from the group consisting of HP 9-4-X where X is the carbon content, AF1410, 4320, 4330, 4340, Martensitic precipitation hardened stainless steels, and modifications of said steels.

A particular steel in which our invention may be used to advantage is HY 180 which has a nominal composition by weight of 0.1% carbon, 10.0% nickel, 8.0% cobalt, 2.0% chromium, 1.0% molybdenum and the balance iron with impurities in usual amounts.

A series of heats were produced having the following chemical compositions:

TABLE I

| Heat | C | Ni | Co | Cr | Mo | Si | Mn | S | P | Ti | Zr | Nb | Al | $N_2$ | $O_2$ |
|---|---|---|---|---|---|---|---|---|---|---|---|---|---|---|---|
| A | .12 | 10.06 | 7.76 | 2.03 | 0.96 | .01 | .11 | .004 | .005 | .005 | .005 | .033 | .004 | 9 | 2 |
| B | .10 | 9.86 | 7.96 | 1.98 | 1.02 | .01 | .31 | .002 | .004 | .004 | .005 | .003 | .002 | 3 | 6 |
| C | .11 | 9.61 | 7.83 | 2.18 | 0.99 | .05 | .04 | .005 | .006 | .020 | .005 | .033 | .008 | 5 | 4 |
| L | .11 | 9.87 | 8.01 | 1.99 | 1.00 | .01 | .01 | .001 | .003 | .021 | .006 | .003 | .005 | 1 | 4 |
| M | .11 | 9.90 | 8.02 | 1.99 | 1.01 | .01 | .01 | .001 | .003 | .012 | .006 | .003 | .005 | 1 | 12 |

Alloy A is a specimen taken from a heat of steel identified as HY180. The heat was intended to be based on commercial practice but its properties were inferior to current commercial heats of this alloy.

Heat B typifies a heat of the same nominal material but in accordance with good current commercial practice.

Heat C shows an HY180 heat which possessed better than usual properties.

Heats L and M are heats made in accordance with the invention of this application.

Mechanical tests made upon specimens from the five heats in Table I are set forth in Table II.

TABLE II

| Heat | Yield Strength (Ksi) | Tensile Fracture Strain | Charpy Impact Energy (ft-lb) | $K_{IC}$ (ksi $\sqrt{in}$) | Primary Inclusion Type | Inclusion Volume Fraction | $R_o$ (5) | $X_o$ (5) |
|---|---|---|---|---|---|---|---|---|
| A | 182 | 1.32 | 69 | 150 | MnS | .00042 | .18 | 2.14 |
| B | 175 | 1.39 | 128 | 227 | MnS | .00021 | .16 | 2.40 |
| C | 179 | 1.45 | 151 | 275 | (3) | .00028 | .12 | 1.63 |
| L | 180 | 1.58 | 197(1) | 400 | (3) | .00019 | .10 | 1.60 |
| M | 183 | 1.65 | 214(1) | 550(2) | (3) | (4) | (4) | (4) |

(1) Samples did not break completely
(2) Calculated value, estimated 500
(3) Carbosulfides
(4) Particles too small to measure in bulk specimens
(5) Microns In Table II $K_{IC}$ expresses plane strain fracture toughness measured in ksi $\sqrt{in}$. It is the stress intensity factor at which fracture occurs. $K_{IC}$ is calculated from $J_{IC}$ results, as follows:

$$J_{IC} = \frac{K_{IC}^2 (1 - \nu^2)}{E}$$

$R_o$ is the average inclusion radius. $X_o$ is the inclusion spacing distance.

It will be seen from the foregoing that alloys L and M made in accordance with the invention have significantly higher Charpy impact and $K_{IC}$ values. It is believed that in those alloys the carbosulfide inclusions tend to be in spherical shape and not as stringers or rods which are elongated by rolling and working. Further, it is believed that high sulfur leads to the production of rod-like inclusions. Thus by maintaining low sulfur limits and by the addition of sufficient titanium to gather the sulfur as carbosulfides the inclusions are spherical and minimize void nucleation. Moreover the low sulfur content tends to reduce the total volume fraction of the inclusions. On a theoretical basis the addition of titanium in twice the atomic percentage of sulfur would bond the sulfur completely to the titanium. Because of the difficulty in achieving absolute homogeneity, some excess titanium is desirably added to insure that all of the sulfur will be bonded while leaving a small amount of excess titanium. Preferably titanium in a range of about 2 to about 7 times the sulfur in atomic percentage is desired to achieve complete bonding of the sulfur.

It is believed that the Charpy and $K_{IC}$ values for alloy C are significantly less than for alloys L and M because the titanium did not convert all of the sulfur to titanium carbosulfides leading to formation of considerable manganese sulfides. Further, it is believed that some of the titanium was tied up in niobium carbonitrides because of the relatively large quantity of niobium and nitrogen in alloy C. Accordingly, the presence of strong carbide forming elements such as zirconium and niobium should be minimized.

An excess of titanium will lead to the presence of undissolved titanium carbides which are undesirable. The presence of titanium up to about 30 times the atomic percentage of sulfur is acceptable. When the amount of titanium exceeds 30 times the atomic of sulfur, however, the risk of undissolved carbides increases unacceptably.

When manganese is present in the alloy, MnS inclusions may be formed with the sulfur leading to undesirable inclusions To limit the formation of MnSs and permit the formation of carbosulfides the manganese should not exceed about 0.1% by weight.

While we have illustrated and described a present preferred embodiment of our invention, it is to be understood that we do not limit ourselves thereto and that the invention may be otherwise variously practiced within the scope of the following claims.

We claim:

1. A high strength vacuum melted ferrous alloy containing titanium carbosulfide inclusions to enhance fracture toughness and comprising not more than about 0.01% by weight sulfur, not more than about 0.1% manganese, and titanium in an amount in atomic percent from about 2 to about 30 times the atomic percentage of sulfur present in the alloy.

2. The alloy of claim 1 in which titanium is present in an amount from about 2 to about 7 times the atomic percentage of sulfur.

3. The alloy of claim 1 in which the ferrous alloy further contains zirconium and niobium in amounts which do not exceed about 0.006% each by weight.

4. A high strength vacuum melted ferrous alloy containing titanium carbosulfide inclusions to enhance fracture toughness and selected from the group consisting of HP 9-4-X where X is the carbon content, AF 1410, 4320, 4330, 4340, martensitic precipitation hardened stainless steels, and modifications of said steels, which alloy comprises not more than about 0.01% by weight sulfur, not more than about 0.1% by weight manganese, and titanium in an amount in atomic percent of not less than about twice the atomic percentage of sulfur present in the alloy.

5. The alloy of claim 4 in which titanium is present in an amount in atomic percent of from about 2 to about 7 times the atomic percentage of sulfur.

6. The alloy of claim 4 in which titanium is present in an amount in atomic percent of from about 2 to about 30 times the atomic percentage of sulfur.

7. The alloy of claim 4 in which the ferrous alloy further contains zirconium and niobium in amounts which do not exceed about 0.006% each by weight.

8. A high strength vacuum melted ferrous alloy having a nominal composition of 0.1% carbon, 10.0% nickel, 8.0% cobalt, 2.0% chromium, 1.0% molybdenum by weight and the balance iron with impurities in usual amounts, in which sulfur is present in amount not exceeding about 0.01% by weight and titanium is present in an amount in atomic percent from about 2 to about 30 times the atomic percentage of sulfur.

9. The alloy of claim 8 in which titanium is present in an amount in atomic percent from about 2 to about 7 times the atomic percentage of sulfur.

10. The alloy of claim 8 in which the ferrous alloy further contains zirconium and niobium in amounts which do not exceed about 0.006% each by weight.

11. A method of manufacturing a high strength alloy which contains titanium carbosulfide inclusions to enhance fracture toughness comprising vacuum melting and refining an alloy having a nominal composition of 0.1% carbon, 10.0% nickel, 8.0% cobalt, 2.0% chromium, 1.0% molybdenum and not more than about 0.1% sulfur by weight, and thereafter adding titanium in an amount of at least about 2 times the atomic percentage of sulfur.

12. A method as set forth in claim 11 in which the titanium is added in an amount in atomic percent of at least about 2 to about 7 times the atomic percentage of sulfur.

13. A method as set forth in claim 11 in which the titanium is added in an amount in atomic percent of at least about 2 to about 30 times the atomic percentage of sulfur.

14. A method as set forth in claim 11 in which the ferrous alloy further contains zirconium and niobium in amounts which do not exceed about 0.006% each by weight.

* * * * *

UNITED STATES PATENT AND TRADEMARK OFFICE

CERTIFICATE OF CORRECTION

PATENT NO. : 5,102,619

DATED : April 7, 1992

INVENTOR(S) : Warren M. Garrison, Jr., Jack W. Bray, James L. Maloney III

It is certified that error appears in the above-identified patent and that said Letters Patent is hereby corrected as shown below:

Columns 1 and 2,

At bottom of Table I, insert

--Values given in Table I are percent by weight except for $N_2$ and $O_2$ which are in parts per million by weight.

--Mechanical and physical values of specimens taken from the heats are set forth in Table II.--

Column 3, lines 1-4, change the equation to read $$--J_{IC} = \frac{K_{IC}^2 (1 - \nu^2)}{E} --$$

Column 3, line 50, after "inclusions" insert a period.

Signed and Sealed this

Twenty-second Day of June, 1993

Attest:

Michael K. Kirk

MICHAEL K. KIRK

Attesting Officer

Acting Commissioner of Patents and Trademarks

UNITED STATES PATENT AND TRADEMARK OFFICE

CERTIFICATE OF CORRECTION

PATENT NO. : 5,102,619

DATED : April 7, 1992

INVENTOR(S) : Warren M. Garrison, Jr., Jack W. Bray, James L. Maloney, III

It is certified that error appears in the above-indentified patent and that said Letters Patent is hereby corrected as shown below:

At bottom of Table I, insert

--Values given in Table I are percent by weight except for $N_2$ and $O_2$ which are in parts per million by weight.

--Mechanical and physical values of specimens taken from the heats are set forth in Table II.--

UNITED STATES PATENT AND TRADEMARK OFFICE

CERTIFICATE OF CORRECTION

PATENT NO. : 5,102,619

DATED : April 7, 1992 Page 2 of 2

INVENTOR(S) : Warren M. Gsrrison, Jr., Jack W. Bray, James L. Maloney, III

It is certified that error appears in the above-indentified patent and that said Letters Patent is hereby corrected as shown below:

Column 3, lines 1-4, change the equation to read $$--J_{IC} = \frac{K_{IC}^{2} (1 - \nu^{2})}{E} --$$

Column 3, line 50, after "inclusions" insert a period.

In the heading, change Item [73] to read:

--Assignee: James L. Maloney III, assignor of his interest to Latrobe Steel Company, Latrobe, PA.--
(part-interest)

Signed and Sealed this

Third Day of August, 1993

*Attest:*

Michael K. Kirk

MICHAEL K. KIRK

*Attesting Officer*

*Acting Commissioner of Patents and Trademarks*